US006285009B1

(12) United States Patent
Barnes et al.

(10) Patent No.: US 6,285,009 B1
(45) Date of Patent: Sep. 4, 2001

(54) ELECTRIC HEATING ELEMENT FOR A COOKING APPLIANCE

(75) Inventors: Shelton T. Barnes, Chattanooga; Perry A. Bennett, Cleveland; Valerie L. Hern-Fonseth, Hixson; David C. Ometer, Cleveland, all of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/382,806

(22) Filed: Aug. 25, 1999

(51) Int. Cl.[7] ..... A21B 1/00; A21B 1/22; F27D 11/00

(52) U.S. Cl. ..... 219/409; 219/405

(58) Field of Search ..... 219/400, 401, 219/403, 405, 409, 413, 542, 35

(56) References Cited

U.S. PATENT DOCUMENTS

| | | |
|---|---|---|
| 2,035,767 | 3/1936 | Schulze . |
| 2,732,475 | 1/1956 | Averill . |
| 2,799,766 | 7/1957 | Tuttle . |
| 2,812,706 | 11/1957 | Francia et al. . |
| 2,824,202 | 2/1958 | Aylor . |
| 2,824,204 | 2/1958 | Reno et al. . |
| 2,844,700 | 7/1958 | Kraus . |
| 2,848,592 | 8/1958 | Mergen . |
| 2,918,560 | 12/1959 | Kruse . |
| 2,922,018 | 1/1960 | Walkoe . |
| 2,973,423 | 2/1961 | Ammerman et al. . |
| 3,005,082 | 10/1961 | Ammerman . |
| 3,024,346 | 3/1962 | Sand . |
| 3,076,886 | 2/1963 | Altman et al. . |
| 3,086,102 | 4/1963 | Meyers . |
| 3,162,754 | 12/1964 | Jasionowski . |
| 3,240,917 | 3/1966 | Price . |
| 3,253,811 | 5/1966 | Hanson . |
| 3,270,660 | 9/1966 | Filipak . |
| 3,296,417 | 1/1967 | Macaulay . |
| 3,334,215 | 8/1967 | Allen, Jr. . |
| 3,405,252 | 10/1968 | Laug . |
| 3,446,941 | 5/1969 | Frick . |
| 3,805,023 | 4/1974 | Wainer et al. . |
| 3,875,371 | 4/1975 | Skinner . |
| 4,950,873 | 8/1990 | Shida et al. . |
| 5,496,987 | 3/1996 | Siccardi et al. . |
| 5,504,295 | 4/1996 | Collas et al. . |
| 5,680,810 | 10/1997 | Sham . |
| 5,701,804 | 12/1997 | Liebermann . |

FOREIGN PATENT DOCUMENTS

158851 * 5/1957 (SE) ..... 219/35

* cited by examiner

*Primary Examiner*—Teresa Walberg
*Assistant Examiner*—L Fastovsky
(74) *Attorney, Agent, or Firm*—Everett G. Diederiks, Jr.

(57) ABSTRACT

An electric heating element for use in an oven cavity of a cooking appliance includes laterally spaced fore-to-aft extending side leg portions which are interconnected by a frontal portion, with each of the side leg portions having an inwardly directed section, followed by an outwardly directed section which leads to the frontal leg portion through respective arcuate corner portions. The electric heating element preferably constitutes a sheathed, resistance coil type element used to provide enhanced uniform heating of the oven cavity for various cooking functions, particularly baking and toasting operations.

18 Claims, 1 Drawing Sheet

ELECTRIC HEATING ELEMENT FOR A COOKING APPLIANCE

BACKGROUND OF THE INVENTION

1. Field of the Invention

The present invention pertains to the art of cooking and, more particularly, to an electric heating element for use in a cooking appliance.

2. Discussion of the Prior Art

In electric cooking appliances, resistance type heating elements are commonly employed to generate a desired temperature within an oven. For instance, conventional electric ovens typically incorporate sheathed, resistance coil heating elements. Actually, separate upper and lower heating elements are traditionally provided adjacent bottom and top walls of an oven cavity for use in connection with baking and broiling functions.

A fair amount of emphasis has been placed in the past on designing electric heating elements in an attempt to enhance the uniform heating of the oven cavity. The electric heating elements used for baking in cooking appliances found on the market today typically assume either a U-shape or a generally M-shape. In each of these arrangements, laterally spaced side leg portions of the heating element extend substantially linearly from a rear portion toward a front portion of the oven cavity.

Although these known arrangements have been used to produce an acceptable flow of heat in the cavity for cooking purposes, there still exists the need for an electric heating element configuration which can be used to develop more uniform heating in an oven cavity. In addition, there exists a need in the art for a reconfigured electric heating element which will enhance the use of the oven cavity for additional cooking operations such as, for example, a toasting operation.

SUMMARY OF THE INVENTION

In a ccordance with the present invention, an electric heating element is configured to include laterally spaced side legs which are interconnected by a front leg, with each of the side legs being formed with an inward bend. In the most preferred form of the invention, the electric heating element is adapted to be mounted adjacent a floor or bottom wall of an oven cavity, with each of the side legs extending forward within the oven cavity and including an inwardly directed section followed by an outwardly direction section which leads to the front leg through arcuate or radiused corner portions. Most preferably, the front leg is also formed with a generally central, inwardly directed bend.

With this configuration, the heating element can effectively be used to create more uniform heating within the oven cavity. For instance, instead of concentrating the heat developed by the side legs solely adjacent side walls of the oven cavity, the inwardly and outwardly directed leg sections provide for a more even heat distribution for improved cooking performance. This enhanced configuration has been found to be particularly advantageous when utilized as a baking element in performing a toasting operation in a compact oven cavity. That is, the inwardly and outwardly directed leg sections can extend substantially directly beneath food item support positions of an oven rack such that an even toasting operation can be performed in combination with a broiling element.

Additional objects, features and advantages of the present invention will become more fully apparent from the following detailed description of a preferred embodiment, when taken in conjunction with the drawings wherein like reference numerals refer to corresponding parts in the several views.

DETAILED DESCRIPTION OF THE PREFERRED EMBODIMENT

Figure 1:
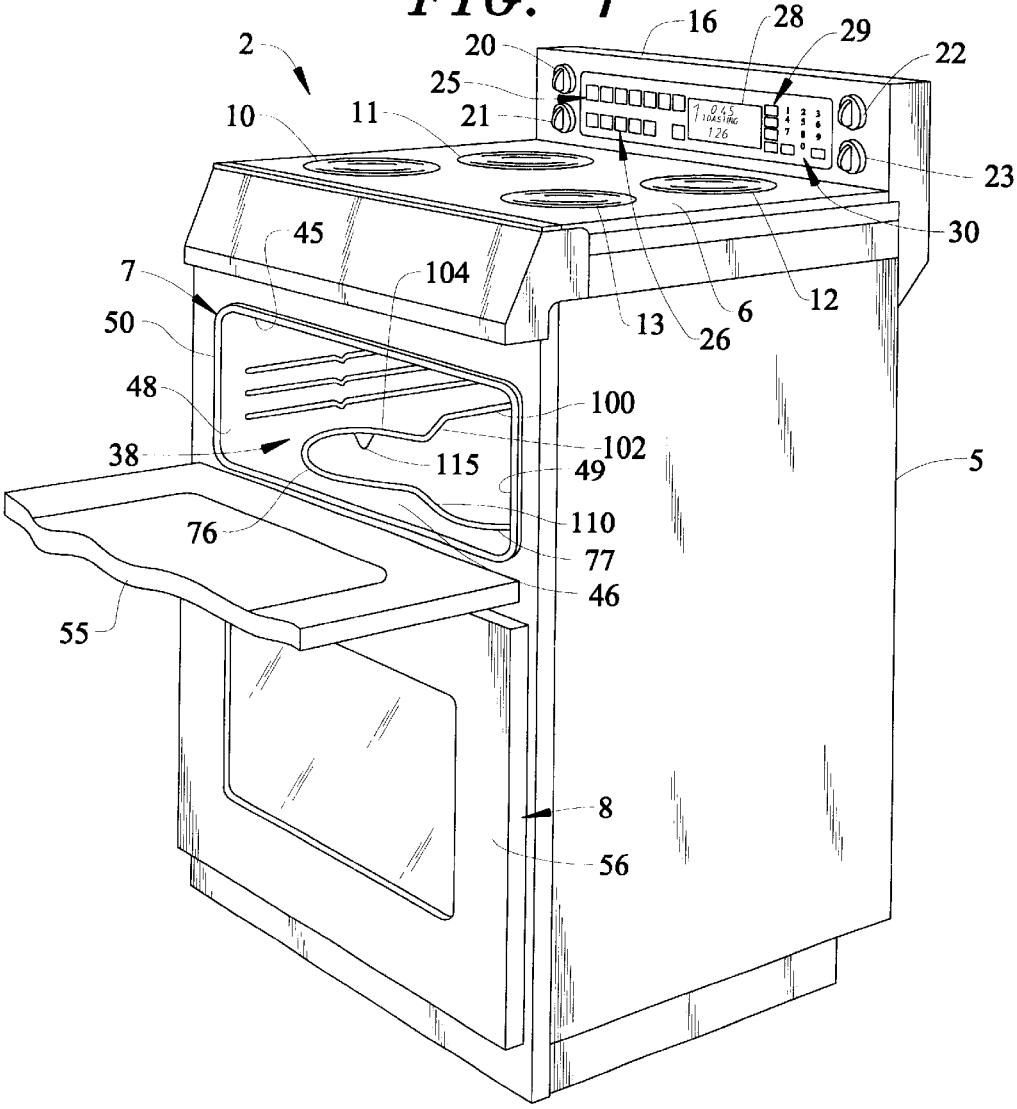
FIG. 1 is an upper right front perspective view of a cooking appliance incorporating an electric heating element constructed in accordance with the present invention.

With initial reference to FIG. 1, the present invention is shown to be incorporated into an electric range generally indicated at 2. Electric range 2 includes a cabinet 5 having an associated range top 6, as well as upper and lower ovens 7 and 8. Range top 6 supports various spaced surface heating elements 10–13 in a manner known in the art. At an upper rear portion, cabinet 5 is provided with a control panel 16. Control panel 16 includes a plurality of knobs 20–23 for use in selectively activating and deactivating surface heating elements 10–13 respectively.

Control panel 16 is also shown to include an upper row of control buttons 25 for upper oven 7, a lower row of control buttons 26 for lower oven 8, a central display 28, such as an LED, LCD or VFD display unit, a vertical row of timing buttons 29 and a number pad, generally indicated at 30, having buttons for the numbers zero (0) through nine (9). In the most preferred form of the invention, control buttons 25 and number pad 30 are used to establish the operation of an electric baking element 35, as well as an electric broiling element (not shown) provided within oven an cavity 38 of upper oven 7. Oven cavity 38 is generally defined by a top wall 45, a bottom wall 46, a rear wall (not labeled) and side walls 48 and 49, as well as an open frontal portion 50 which can be selectively closed by a door 55. Of course, a similar arrangement, including a door 56, is provided for lower oven 8.

Figure 2:
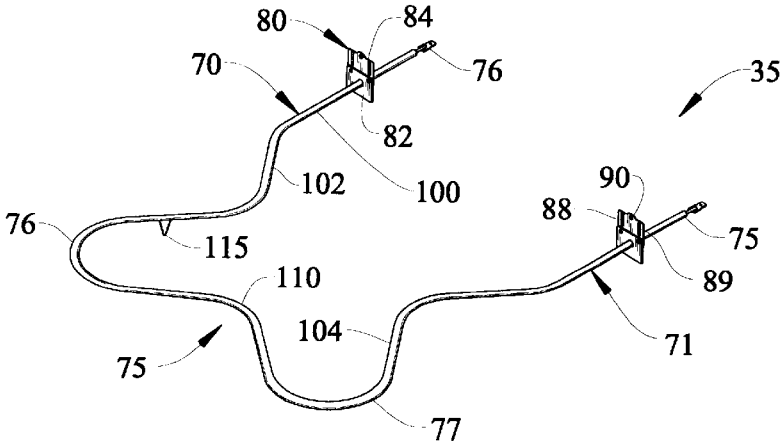
FIG. 2 is an upper right perspective view of the electric heating element shown in FIG. 1.

The present invention is particularly directed to the construction of heating element 35 and it should be understood that the general construction of range 2 as described above is known in the art and really provided for the sake of completeness. However, at this point, it should also be realized that the present invention is equally applicable to various types of cooking appliances as will become more fully apparent from the following detailed description of heating element 35 with reference to both FIGS. 1 and 2.

In the most preferred form of the invention, heating element 35 constitutes an electric, resistance coil heating element which is sheathed. As shown, heating element 35 includes a pair of spaced, side leg portions 70 and 71 which are interconnected by a front leg portion 75 through arcuate or radiused corner portions 76 and 77. In general, side leg portions 70 and 71 are mirror images of each other. In any event, each side leg portion 70, 71 includes a terminal end 75 having attached thereto an electrical connector 76. Spaced from terminal end 75 of each side leg portion 70, 71 there is provided a mounting bracket assembly 80. In the embodiment shown, mounting bracket assembly 80 includes a first metal plate 82 which is riveted, welded or otherwise affixed to a second metal plate 84. As shown, each plate 84 is provided with embossed portions 88 and 89, as well as an aperture 90. Apertures 90 are used in combination with mechanical fasteners (not shown) for securing heating element 35 to rear wall 47 of oven cavity 38.

At this point, it should be recognized that the manner in which heating element 35 is attached to a source of electrical energy through the connectors 76 provided at terminal ends 75 is known in the art such that the same will not be detailed further here. However, it should be realized that various terminal connector arrangements are known in the art and the present invention is equally applicable to these known arrangements. That is, terminal ends 75 can be laterally spaced to extend through separate openings provided in rear wall 47 as in accordance with the embodiment shown or terminal ends 75 can extend towards one another such that only a single opening needs to be provided.

Each side leg portion 70, 71 is adapted to generally extend forward within oven cavity 38 and actually includes a first, substantially straight or linear section 100, an inwardly directed section 102 and an outwardly directed section 104. Each outwardly directed section 104 leads to front leg portion 75 through a respective corner portion 76, 77. Therefore, with this construction, each side leg portion 70, 71 includes an inward bend defined by inwardly and outwardly directed sections 102 and 104. In the most preferred form of the invention, front leg portion 75 also includes an inward bend, such as indicated at 110.

As mentioned above, side leg portions 70 and 71 are adapted to be attached to rear wall 47 of oven cavity 38 through respective mounting bracket assemblies 80. In addition, support legs, such as that indicated at 115, are also affixed, such as by welding, along the length of heating element 35. Each support leg 115 is adapted to abut bottom wall 46 of oven cavity 38. In the most preferred form of the invention, a separate support leg 115 depends from the outwardly directed section 104 of each side leg portion 70, 71. In the most preferred form, each support leg 115 is constituted by a bent wire.

With this construction for heating element 35, it has been found that a more uniform heating can be developed for oven cavity 38. In addition, enhanced operations can be performed with within oven cavity 38. For instance, a toasting operation can be performed within oven cavity 38 upon a rack (not shown) supported above heating element 35, wherein bread or the like can be positioned substantially directly above inwardly and outwardly directed sections 102 and 104. Here, the compact nature of oven cavity 38 provides for a relative close relationship between heating element 35 and the broiling element for oven cavity 38. This compact configuration, in combination with the construction of heating element 35, has been found to profoundly influence the ability of a toasting operation to be performed with range 2. A rack designed to enhance cooking and toasting operations by providing specified food support portions is described in a U.S. application entitled "OVEN RACK" filed on even date herewith which is assigned to the same assignee as the present case and incorporated herein by reference. This rack can be advantageously used in combination with the present invention to arrange the rack support portions generally directly above inwardly and outwardly directed sections 102 and 104. In any event, the heating element 35 of the present invention has been found to provide for an overall enhanced cooking with oven cavity 38.

Although described with reference to a preferred embodiment of the invention, it should be recognized that various changes and/or modifications can be made to the invention without departing from the spirit thereof. For example, although heating element 35 has been described for use as a baking element, it should be recognized that the disclosed configuration could also be used for a broiling element as well. In addition, heating element 35 could also be used in larger oven cavities, although it has been found that at least the toasting feature diminishes with larger oven cavities. In any event, the invention is only intended to be limited by the scope of the following claims.

We claim:

1. An electric heating element for use in a cooking appliance including an oven cavity having top, bottom, rear and side walls, as well as an open front adapted to be selectively closed off by a pivotally mounted door, comprising: first and second laterally spaced side leg portions adapted to extend forward within the oven cavity; and a frontal leg portion interconnecting the first and second side leg portions, each of said first and second side leg portions including an inwardly directed section, followed by an outwardly directed section which leads to the frontal leg portion, each of the first and second side leg portions further including an elongated, substantially straight, fore-to-aft extending section leading to the inwardly directed section in one direction and to a terminal electrical connector in another direction.

2. The electric heating element according to claim 1, wherein the electric heating element constitutes a sheathed coil heating element.

3. The electric heating element according to claim 1, further comprising: supports projecting downward from at least one of the inwardly and outwardly directed sections of each of the first and second side leg portions.

4. The electric heating element according to claim 3, wherein the supports project downward from the outwardly directed sections of the first and second side leg portions.

5. The electric heating element according to claim 4, wherein the supports are constituted by wires.

6. The electric heating element according to claim 1, wherein the frontal leg portion includes a substantially central, inward bend.

7. The electric heating element according to claim 6, wherein the frontal leg portion is interconnected to the outwardly directed sections of the first and second side leg portions through radiused corners of the electric heating element.

8. The electric heating element according to claim 1, wherein each of the outwardly directed sections leads directly to the frontal leg portions through respective arcuate corner portions of the electric heating element.

9. An electric baking element comprising:

first and second spaced side leg portions, each of the first and second side leg portions including a first leg section leading to a second leg section and then a third leg section, with the first leg section constituting by an elongated, substantially linear section, with the second leg section of the first side leg portion extending towards the second side leg portion and the second leg section of the second side leg portion extending towards the first side leg portion, and with the third leg section of the first side leg portion extending away from the second side leg portion and the third leg section of the second side leg portion extending away from the first side leg portion; and a frontal leg portion interconnecting the first and second leg portions.

10. The electric heating element according to claim 9, further comprising: arcuate corner sections joining the first and second side leg portions and the frontal leg portion.

11. The electric heating element according to claim 9, wherein the frontal leg portion includes a substantially centrally located inward bend.

12. The electric heating element according to claim 11, wherein the frontal leg portion is interconnected to the outwardly directed sections of the first and second side leg portions through radiused corners of the electric heating element.

13. The electric heating element according to claim 9, further comprising: supports projecting downward from at least one of the inwardly and outwardly directed sections of each of the first and second side leg portions.

14. The electric heating element according to claim 13, wherein the supports project downward from the outwardly directed sections of the first and second side leg portions.

15. The electric heating element according to claim 14, wherein the supports are constituted by wires.

16. A method of heating a compact oven cavity of a cooking appliance used for both baking and toasting operations comprising: activating an electric baking element provided adjacent a bottom wall of the oven cavity, with the baking element including forward extending side leg portions having fore-to-aft extending, elongated straight rear sections leading to inwardly directed sections followed by outwardly directed sections which lead to a frontal portion of the baking elements.

17. The method according to claim 16, further comprising: providing the frontal leg portion with a substantially central, inward bend.

18. The method according to claim 17, further comprising: interconnecting the outwardly directed sections of the side leg portions to the frontal leg portion through radiused corners.

* * * * *